United States Patent [19]

Thomas

[11] 4,087,217

[45] May 2, 1978

[54] VANE SUPPORT ASSEMBLY FOR ROTARY TYPE POSITIVE DISPLACEMENT APPARATUS

[76] Inventor: Albert Raymond Thomas, 7313 South Gessner, Houston, Tex.

[21] Appl. No.: 738,614

[22] Filed: Nov. 3, 1976

Related U.S. Application Data

[62] Division of Ser. No. 581,956, May 28, 1975, Pat. No. 4,008,020.

[51] Int. Cl.[2] ..... F01C 1/00; F03C 3/00; F01C 21/00

[52] U.S. Cl. ..... 418/258; 418/235

[58] Field of Search ..... 418/235, 253, 257, 258, 418/266

[56] References Cited

U.S. PATENT DOCUMENTS

| | | | |
|---|---|---|---|
| 256,781 | 4/1882 | Winkler | 418/258 |
| 284,698 | 9/1883 | Wigmore | 418/258 |
| 341,395 | 5/1886 | Ainsworth | 418/258 |
| 549,615 | 11/1895 | Saxton | 418/258 |
| 688,947 | 12/1901 | Guindon | 418/257 |
| 1,505,788 | 8/1924 | Larson et al. | 418/258 |
| 2,367,326 | 1/1945 | Beckman | 418/258 |
| 2,459,071 | 1/1949 | Garrison | 418/258 |
| 3,544,245 | 12/1970 | Mowbray | 418/258 |

FOREIGN PATENT DOCUMENTS

| | | | |
|---|---|---|---|
| 8,689 of | 1927 | Australia | 418/258 |

*Primary Examiner*—John J. Vrablik
*Attorney, Agent, or Firm*—Kenneth R. Glaser

[57] ABSTRACT

Disclosed is a vane support assembly for interconnecting and supporting the diametrically opposed vanes in rotary type positive displacement apparatus. Alternate embodiments translatably couple the support rods with the vanes or rigidly couple the support rods with the opposed vanes and translatably couple intermediate portions thereof. Alternate forms of bearing assemblies are disclosed in conjunction with the assembly as well as various positioning of the associated springs.

6 Claims, 15 Drawing Figures

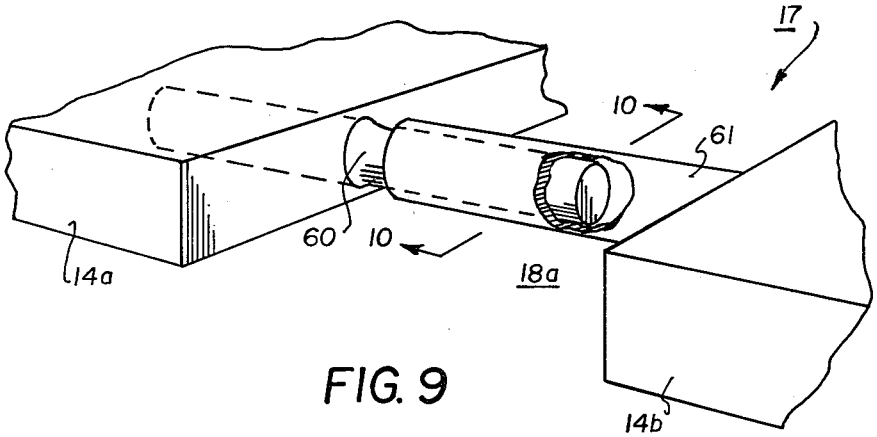
FIG. 9
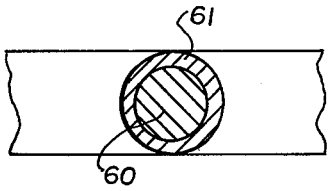
FIG. 10
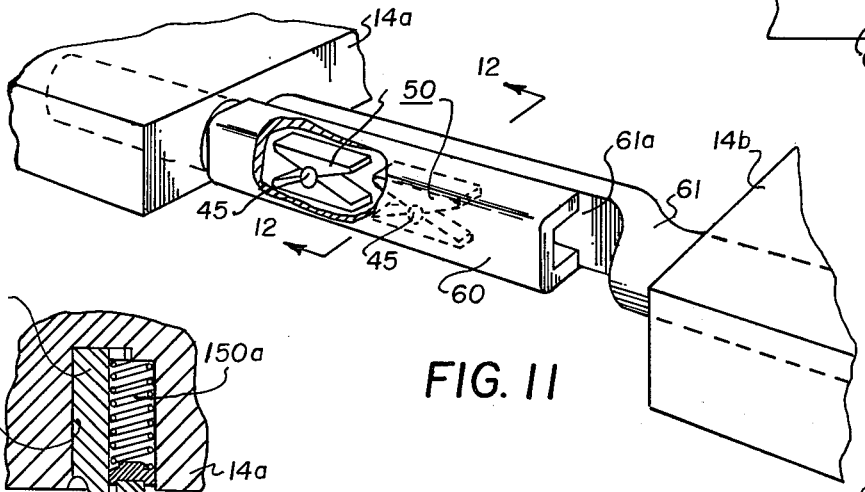
FIG. 11
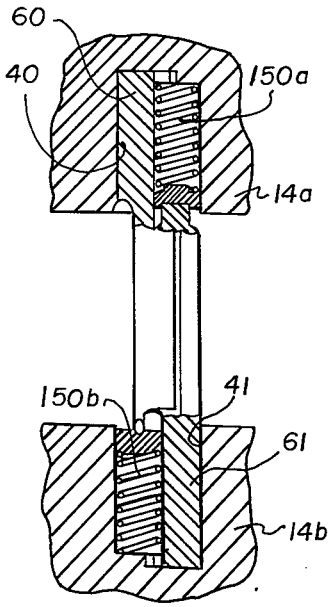
FIG. 15
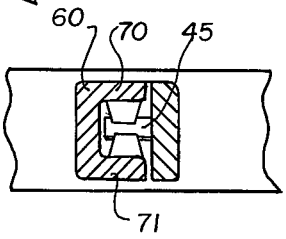
FIG. 12
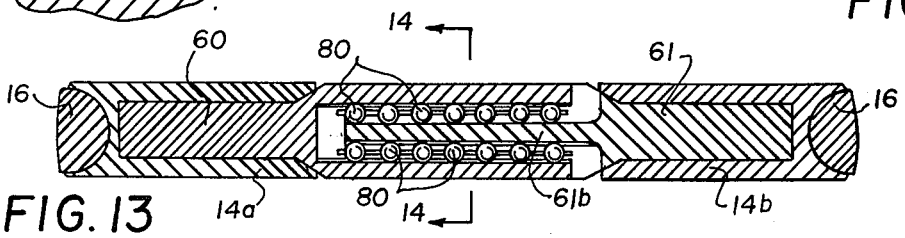
FIG. 13
FIG. 14
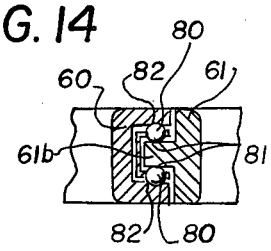

VANE SUPPORT ASSEMBLY FOR ROTARY TYPE POSITIVE DISPLACEMENT APPARATUS

This is a division of application Ser. No. 581,956, filed May 28, 1975, now U.S. Pat. No. 4,008,020.

The present invention relates to rotary type positive displacement apparatus, more particularly to rotary engines, pumps, and the like having variable volume working chambers defined by a stator housing, an eccentrically mounted rotor, (and associated radially movable vanes) and even more particularly to an improved system for structurally supporting and interconnecting opposed vanes for such apparatus.

The last decade has witnessed a rapid growth of interest in rotary type positive displacement fluid apparatus used as pumps, motors, compressors, and the like. In particular, current research and development is being directed to improvements of such type apparatus employing a stator defined by a substantially cylindrical peripheral wall and end plates, a rotor eccentrically mounted for rotation within the stator housing; and vane assemblies mounted with the rotor and comprising paired sets of vanes reciprocating between extended and retracted positions within diametrically opposed longitudinally and radially extending slots disposed around the circumference of the rotor, the rotor, stator, and vanes cooperating to provide a plurality of variable volume working chambers containing the working or displacement fluid (water, steam, air-fuel mixture, etc.). Most recently, such rotary type apparatus has received increased attention as a possible replacement for the conventional piston-type internal combustion engine. My earlier U.S. Pat. No. 3,858,559, discloses an improved version of such rotary type apparatus which has particular application as an internal combustion engine.

Rotary pumps and motors of the aforementioned type, and particularly of the improved nature described in U.S. Pat. No. 3,858,559, offer numerous advantages over conventional non-rotary apparatus, including reduction of moving parts, decreased weight and size, and improved economy of manufacture and operation. Realization of the full commercial potential for such type of apparatus, however, requires an effective support system for mounting the entire vane assembly with the rotor as well as interconnecting opposed vanes in a manner which facilitates the non-binding reciprocation of the vanes, assures that the vanes maintain continuous sealing engagement with the stator housing as they extend and retract within the slots of the revolving rotor, and prevents the bending of the vanes out of their preferred radial and longitudinal positions.

It is therefore a principal object of the present invention to provide a new and improved vane support system for rotary type positive displacement apparatus.

It is another object of the invention to provide improved means for mounting sets of diametrically opposed radial vanes with the eccentrically mounted rotor of rotary type positive displacement apparatus.

It is a still further object of the invention to effectively interconnect and support diametrically opposed radial vanes in a manner which allows the vanes to reciprocate without binding in the rotor slots, which assures that the vanes maintain continuous sealing engagement with the stator housing of the rotary apparatus during rotation of the rotor, and in a manner which prevents the bending of the vanes out of their preferred radial and longitudinal positions.

It is an even still further object of the invention to provide new and improved rotary pumps, motors, and the like.

In accordance with these and other objects, the present invention is directed to alternate preferred embodiments of a support rod assembly which not only supportably mounts the vanes with the rotor, but which interconnects opposed radial vane pairs to facilitate their radial movement with respect to one another while maintaining the vanes in their preferred radial and longitudinal positions and in continuous sealing engagement with the stator housing.

The support rod assemblies preferably comprise a pair of support rods for each vane pair which either involves the rigid attachment of one end of a support rod with one vane and translatable coupling of the other end with the opposed vane or the rigid attachment of both ends of the support rods with the vanes and translatable coupling intermediate the vanes. The translatable coupling is effected by unique bearing assemblies; and the support rods, as opposed to the rotor slots, preferably provide the principal means for maintaining the vanes in their preferred radial and longitudinal orientation.

Additional features, as well as other objects and advantages, of the present invention will become more readily understood from the following detailed description taken in conjunction with the attached drawings, in which:

FIG. 9 is a pictorial representation of the vane support assembly in accordance with an alternate embodiment of the invention;

FIG. 10 is a sectional view of a portion of the assembly depicted in FIG. 9 taken along section lines 10—10 and illustrating the bearing assembly thereof;

FIGS. 11 and 12 is of an assembly similar to that depicted in FIG. 9 illustrating a modified form of bearing therefor;

FIGS. 13 and 14 is of an assembly similar to that of FIGS. 11 and 12 illustrating a different type of bearing therefor; and FIG. 15 is a sectional view showing the relative disposition of the springs which can be employed for any of the assemblies depicted in FIGS. 9 - 14.

Figure 1:
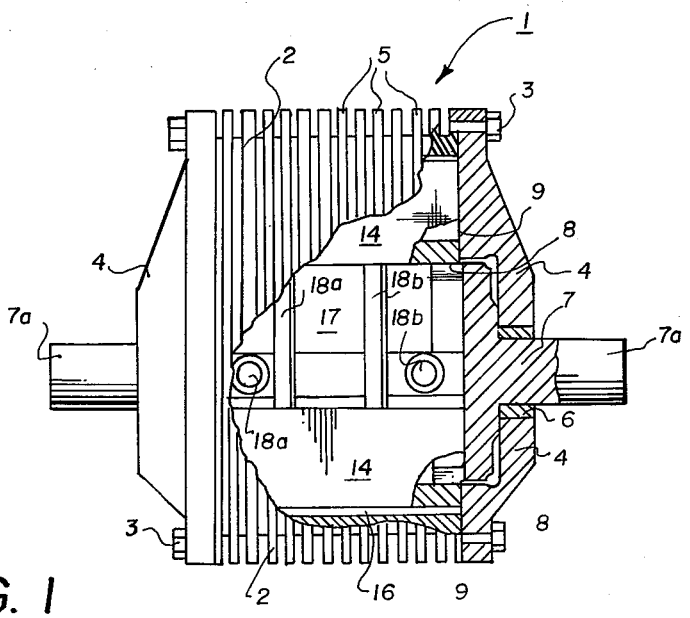
FIGS. 1 and 2 depict, partially in section, one stage of rotary type positive displacement apparatus generally showing the cooperative relationship between the stator housing, eccentrically mounted rotor, and associated vanes.
Figure 2:
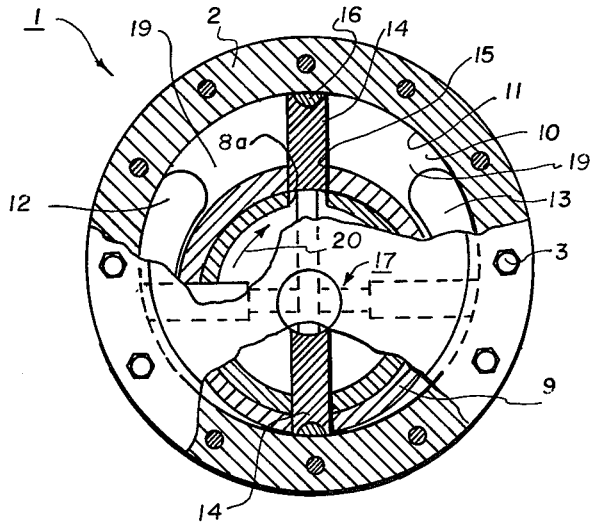

Referring initially to FIGS. 1 and 2, a single stage of rotary type positive displacement apparatus is depicted by the reference numeral 1 and comprises an outer cylindrical casing 2 to which is attached (by suitable fasteners 3) a pair of end wall castings 4. The outer casing 2 is preferably provided with a plurality of circumferential cooling ribs 5 to assist in the transfer of heat energy from the apparatus 1, thereby reducing its overall operating temperature.

Journaled for rotation within, and eccentrically mounted to, the end walls 4 by way of bushings 6 are a pair of circular plates 7 having centrally disposed shaft extensions 7*a*. Each of the plates 7 additionally have annular extending ribs 8 which are inserted into the interior of a hollow cylindrical drum forming the rotor 9. The rotor 9 is thus eccentrically mounted to rotate within a main chamber 10 (FIG. 2) defined by the interior surfaces of the end wall castings 4 and the cylindrical peripheral wall 11 of the outer stator casing 2; and can be rotatably driven in the direction of arrow 20 by suitably rotating either one of the shaft extensions 7*a* by a power source (not shown) coupled thereto. Respective input and output ports 12 and 13 can be provided in either or both end wall castings 4 and are of suitable shape and configuration to enable the entry and exit of the working or displacement fluid to and from the main chamber 10.

A plurality of vanes 14 having a size and shape effective to slidably and sealably engage the internal surfaces of the end walls 4 are mounted with, and equally spaced around, the rotor 9 and are adapted to reciprocate within diametrically opposed, longitudinally and radially extending rotor slots 15 (and, where necessary, through slots 8*a* in extending ribs 8). The slots 15 open to both the rotor periphery and the interior of the hollow rotor to enable the vanes to extend beyond the rotor and engage the chamber wall 11 as well as to retract within the rotor during its rotation.

Each of the vanes are preferably provided with seals 16 at their tips and, as subsequently described in greater detail, maintain continuous sealing engagement with the interior of the peripheral wall 11. While two pair of vanes are, for convenience of illustration, depicted in FIG. 2 it is contemplated that additional pairs of vanes can be employed if desired. Thus, the vanes, rotor, and interior portion of the stator housing (peripheral wall 11 and end plates 4), cooperate to divide the main chamber 10 into a plurality of smaller working chambers 19 disposed between adjacent vanes, the volume of which will vary as the rotor 9 (and vanes 14) is rotated within the housing.

The vanes 14 are mounted with the rotor, and with respect to one another, by a vane support assembly 17 which include transversely disposed sets of paired support rod means (generally designated by reference numerals 18*a* and 18*b*). Since the construction and operation of the assembly constitute the essence of the present invention, and will therefore be subsequently described in greater detail; it is sufficient to merely note at this point that the vane support assembly (and particularly rod means 18*a* and 18*b*) extends and can move through the hollow center of the rotor, and is effective to mutually and translatably couple diametrically opposed vane pairs in a manner which allows the opposed vanes to radially move with respect to one another as well as with respect to the rotor, maintains the vanes in continuous sealing engagement with the stator housing, and supports the vanes in their preferred radial and longitudinal orientation. Spring means (not illustrated in FIGS. 1 and 2) are associated with the vane support assembly and maintains the vanes in their extended position during starting, and low speed operation, of the rotary apparatus 1 when the centrifugal forces acting on the vanes are at their minimum. Additionally, the support rod means, as distinguished from the slots 15, preferably provide the sole, or at least principal, means for supporting the vanes against bending due to pressures within the chamber.

The single stage 1 of the rotary apparatus depicted in FIGS. 1 and 2 can be utilized, for example, as a fluid pump in the manner described in greater detail in U.S. Pat. No. 3,858,559. Briefly stated, the working chambers 19 between adjacent vanes 14 vary in volume as the rotor 9 is rotated in the direction of arrow 20 due to the eccentric mounting of the rotor and the face that the vanes will reciprocate within the rotor slots 15 between fully retracted and fully extended positions, always maintaining sealing contact at their forward ends with the peripheral wall 11 (as well as along the side or end walls of the chamber). Fluid entering the entry port 12 will be trapped between adjacent vanes and thereafter moved in a clockwise direction to the outlet port 13.

Furthermore, and as also described in U.S. Pat. No. 3,858,559, by appropriately interconnecting two stages having a construction similar to the previously described apparatus stage 1, a rotary type internal combustion engine can be provided. Accordingly, and with reference now to FIG. 3, a compression stage 30 for inducting and compressing air is operatively combined with a combustion stage 31 for burning a mixture of fuel and the so-compressed air. Similar to that previously described, the compression chamber 30*a* is defined by the interior surfaces of an end wall casting 32, central wall casting 33, and an outer cylindrical casing 34. Likewise, a combustion chamber 31*a* is defined by the interior surfaces of an end wall casting 21, central wall casting 22, and an outer cylindrical casing 23. A plurality of cooling ribs 24 can be provided around the circumference of the outer casings 23 and 34 to aid in the transfer of heat from the engine.

A pair of thin walled cylindrical rotors 35 and 25 are respectively eccentrically mounted to rotate within the compression and combustion chambers 30*a* and 31*a*. The compression rotor 35 is mechanically connected, as previously described, to a circular plate 36 having shaft extension 36*a* which is journaled for rotation within end wall casting 32; and the combustion rotor 25 is mechanically connected to a circular plate 26 having shaft extension 26*a* and journaled for rotation within end wall casting 21. In addition, the compression and combustion rotors are connected together by way of integrally joined circular plates 27 and 28 having extending ribs 27*a* and 28*a* which are inserted into the interior of rotors 35 and 25, the integrally formed plates 27 and 28 journaled for rotation within the central wall castings 22 and 33 by way of bushing 29. Thus, the compression and combustion rotors, which are eccentrically mounted for rotation within their respective housings, are connected to rotate in unison.

Figure 3:
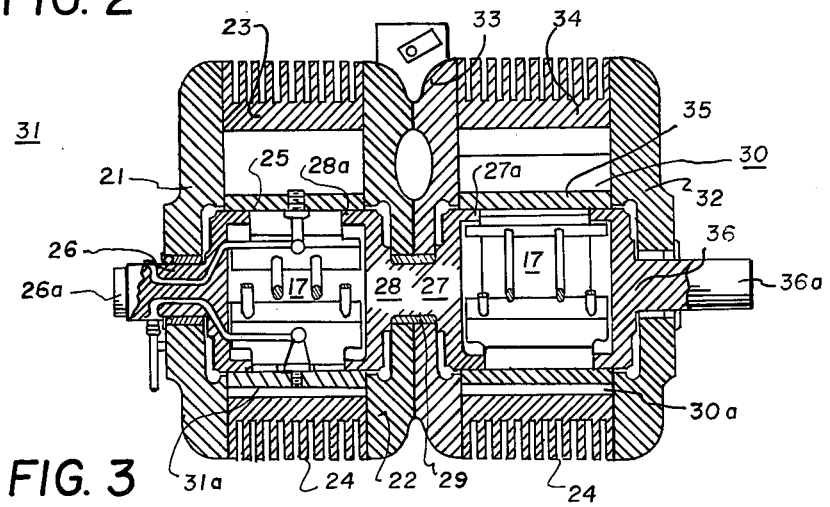
FIG. 3 depicts the interconnection of two stages of apparatus similar to that depicted in FIGS. 1 and 2 to provide an internal combustion engine.

Additional specific details of the structure and operation of the engine depicted in FIG. 3, not necessary for the understanding of the improvement of the present invention, are contained in U.S. Pat. No. 3,858,559. It can be generally observed, however, that the two stage (compression and combustion) rotary engine would also include means for introducing air into the compression chamber 30*a*; means for transferring the compressed air from the compression chamber into the combustion chamber; fuel injector means for injecting fuel into the combustion chamber; ignitor means (shown in FIG. 3 as connected to the combustion stage rotor) for appropriately igniting the fuel-air mixture; and exit ports in the combustion stage for exhausting the combustion products. Combustion within the combustion stage 31 rotates the combustion rotor 25, simultaneously rotating the compression rotor 35; and power can be derived from the engine by attaching suitable transmission or gearing at the shaft 26*a*.

The construction of the rotor and coupled vane assemblies within each of the compression and combustion chambers 30*a* and 31*a* is essentially identical to that previously described, the chambers being divided into appropriate variable volume working chambers. The vane support assembly 17 in each stage would then be identical in construction, the details of which are now described.

Figure 4:
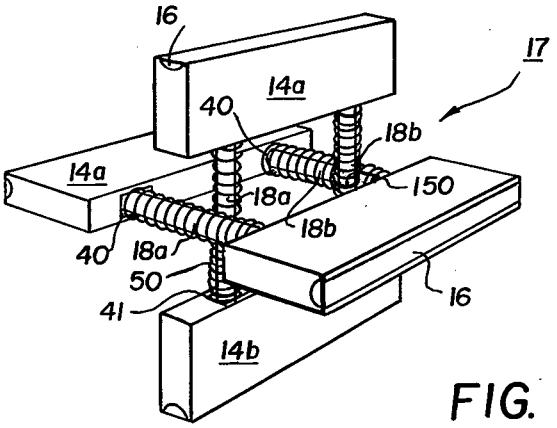
FIG. 4 is a pictorial representation of the vane support assembly in accordance with one preferred embodiment of the invention for structurally supporting and interconnecting the vanes with one another and with the rotor.

The essence of the present invention resides in the unique construction and operative relationship of the vane support assembly 17, alternate preferred embodiments thereof being depicted in FIGS. 4–15. Specifically, and with initial reference to FIGS. 4–6, a first preferred embodiment of the assembly 17 has each of the support rod means 18*a* and 18*b* formed as cylindrical rods of one-piece construction extending between, and suitably coupling, opposed vane pairs (conveniently designated 14*a* and 14*b*). While one set of the support rods (coupling one vane pair) is illustrated in FIG. 4 as being disposed entirely within the set of transversely oriented rods of the other set (coupling the other vane pair), it is also contemplated that the two sets of rods could be staggered with respect to one another.

Figure 5:
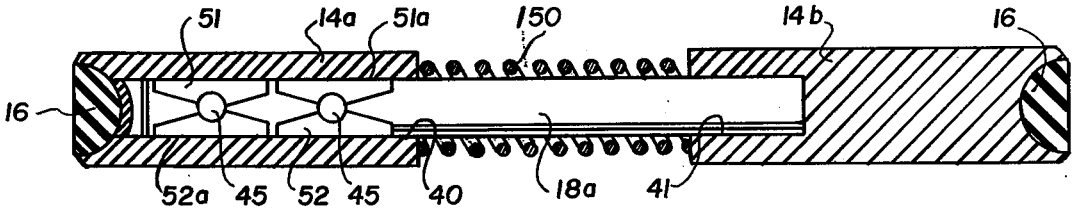
FIGS. 5 and 6 depict one type of bearing assembly to be employed in the vane support assembly of FIG. 4.

The rods 18*a* and 18*b* of each set have opposed ends thereof respectively extending into spaced openings or sockets 40 and 41 in opposed vanes 14*a* and 14*b*, which sockets are radially aligned with the rotor slots 15. In this embodiment, one end of each rod would be rigidly connected within a vane socket while its opposed end is translatably coupled in the socket of the opposing vane. For example, as illustrated in FIG. 5, support rod 18*a* has one end rigidly attached (press-fitted, for example) in the socket 41 of vane 14*b*, and its opposed end slidably and translatably received within the socket 40 of vane 14*a*. In such instance, the other support rod 18*b* would be coupled in the reverse manner with one end thereof rigidly attached within the laterally spaced socket 40 of vane 14*a* and its other end translatably coupled with vane 14*b* in socket 41. With the opposed vanes interconnected in this manner, each vane is structurally supported by one of the rods (either 18*a* or 18*b*) and is movably coupled to the opposed vane in a manner which allows the paired vanes 14*a* and 14*b* to radially move with respect to one another during the rotor rotation. Additionally, each set of rods of the assembly 17 is free to move through, and with respect to, the rotor. Helical coil springs 150 are disposed around each of the rods 18*a* and 18*b* and bear against the vanes, in the manner illustrated in FIGS. 4 and 5, to yieldingly urge the opposed vanes toward their extended position, particularly during the time when the centrifugal forces acting on the vanes are at their lowest. Each of the vane sockets (particularly the ones translatably receiving the support rods) are also suitably lubricated.

In accordance with a unique feature of the present invention, a bearing assembly is provided at the end of the support rod which is movably and translatably coupled with the vane, which bearing assembly not only prevents the vane binding in the rotor slot due to any canting of the rod, but also facilitates the formation of a hydrodynamic oil film between the movable rod and vane to assist in the reciprocal movement of the vane. Since the structure and vane interconnection of the support rods 18*a* and 18*b* would be the same, although reversed in orientation, the following description of the bearing assembly is referenced, for convenience, only to the support rod 18*a*.

Figure 6:
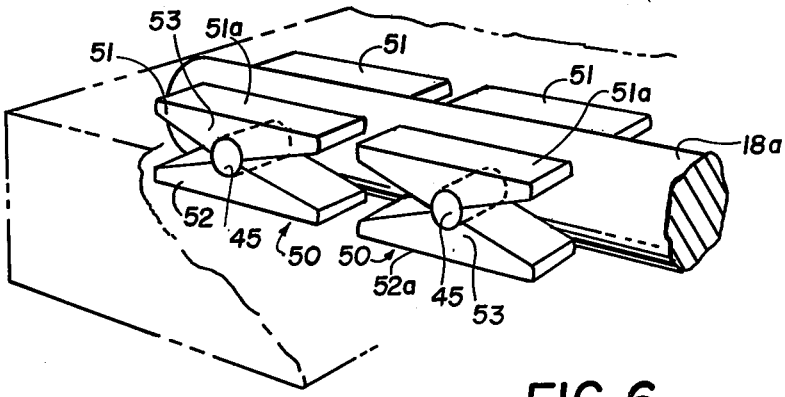

Accordingly, support rod 18*a* includes one or more sets of integrally joined cylindrical projections 45 on opposed sides thereof and adjacent the portion of the rod received within the socket 40 (the projections on only one side being depicted in FIGS. 5 and 6. Snugly, but slidably disposed within the socket 40 (or constrained by runners therein) are tilting pad assemblies 50 (four sets of which are shown in FIG. 6), each set comprising reverse-oriented tilting pads 51 and 52 having semi-circular cut-outs 53 aligned with one another and of suitable size and configuration to pivotally receive the cylindrical projections 45 on each side of the rod 18*a*. The opposed flat faces 51*a* and 52*a* of the tilting pads will slidably bear against the flat surface portions of the socket 40, thus providing a sliding bearing assembly for the end of the rod 18*a* which not only restrains the vane against tilting, but additionally allows the formation of the hydrodynamic oil film between the flat faces of the tilting pads and the socket to facilitate radial movement of the opposed vanes with respect to one another.

Figure 7:
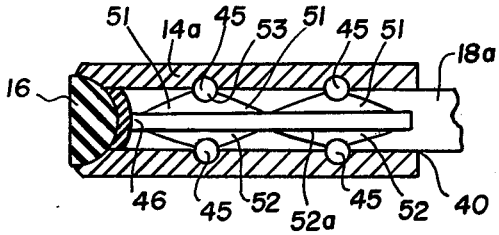
FIGS. 7 and 8 depict another type of bearing assembly to be employed in the vane support assembly of FIG. 4.
Figure 8:
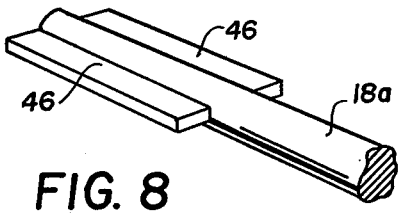

A slightly modified version of the previously described bearing assembly, but providing the same advantages, is depicted in FIGS. 7 and 8. In this instance, opposed runners 46 would be integrally formed with, and project from, opposed sides of the support rod 18*a*; the tilting pads 51 and 52 would be reversed from that previously shown with the flat portions 51*a* and 52*a* slidably engaging opposite sides of the runners 46, and the cylindrical projections 45 could be disposed in semicircular transverse channels in the socket walls mutually aligned with the cut-outs 53 of the tilting pads.

In many applications, it may be disadvantageous to locate the bearing assemblies for the support rods within the vanes themselves, as previously described. For example, when the rotary vane apparatus is employed as internal combustion engine, the heat existing within the combustion stage thereof may be sufficient to carbonize the lubricating oil around the bearing. Additionally, the difficulty of convenient access to the bearing assembly for maintenance purposes, as well as constraint placed upon the type of bearings that can be employed, may require that the translatable coupling of the vanes be disposed between, rather than within, those vanes.

In accordance with this object, and with reference now to FIG. 9, an alternate embodiment of the vane support assembly 17 would have both support rod means 18*a* and 18*b* (only one, 18*a*, of which is shown in the drawings) divided into two elongated portions 60 and 61, one end of both of these portions being rigidly connected in radial alignment with the opposed vanes 14*a* and 14*b* (within the respective sockets 40 and 41). One of the elongated portions, for example portion 60, has its free end configured as a solid cylinder, the other elongated portion 61 having its free end configured as a hollow cylinder of a shape and diameter to slidably and telescopingly receive the end of rod 60. The two rod portions 60 and 61 are thereby translatably coupled at a location within the rotor center, and the resulting sliding bearing thereat enables the radial movement of opposed vanes 14*a* and 14*b* with respect to one another.

A modified version of the bearing connection shown in FIGS. 9 and 10 is depicted in FIGS. 11 and 12 and basically employes the tilting pad bearing assembly previously described. Specifically, the elongated portion 60 now has its free end formed with a C-shaped cross-section defining elongated runners 70 and 71, the tilting pad assemblies 50 being disposed within the confines of the C-shaped channel and which faces 51*a*, 52*a* are adapted to respectively slide along the inside surfaces of runners 70 and 71. The free end of the elongated portion 61 is configured with a flat face 61*a* portion being disposed against the lateral positions of the runners 70 and 71 and, in the manner previously described, includes cylindrical projections 45 which are pivotally received within the mutually aligned semi-circular recesses 53 of the tilting pads. Thus, the support assembly depicted in FIGS. 11 and 12 provides the same advantages as that previously discussed with respect to FIGS. 5 and 6; but additionally disposes the bearing assembly intermediate the opposed vanes.

Each of the sliding bearing assemblies depicted in the embodiments of FIGS. 9 (and 10) and 11 (and 12) may be replaced by an anti-friction bearing assembly comprising suitable roller or ball bearings, for example. Specifically, and with reference now to FIGS. 13 and 14, the free end of elongated portion 60 has the C-shaped cross-section as before; while the free end of elongated portion 61 has a T-shaped cross-section. The projection 61*b* of the T-shaped portion 61 is then mateably received within the C-shaped channel, as illustrated in FIG. 14, a plurality of ball bearings 80 adapted to roll within inner and outer races 81 and 82 respectively formed in the T-shaped and C-shaped elongations 61 and 60. Thus, the support rod portions 60 and 61 (and connected vanes 14*a* and 14*b*) are translatably coupled at their intersection by an essentially frictionless bearing arrangement facilitating the to and fro motion thereof.

In a manner similar to that shown in FIG. 4, the helical springs 150 may be disposed between the vane pair, but now completely around the coupled sections 60 and 61 of the support rod means 18*a* and 18*b*. On the other hand, and particularly when limited space between opposed vanes requires such, each of the springs 150 may be divided into separate spring portions 150*a* and 150*b* which are respectively inserted within sockets in the vanes 14*a* and 14*b* immediately adjacent the sockets 40 and 41 in which the elongated members 60 and 61 are attached, all as depicted in FIG. 15. Each of the springs are yieldably urged against the appropriate elongated portion (spring 150*a* against rod portion 61; spring 150*b* against rod portion 60) to provide the necessary force to extend the opposing vanes.

Various modifications to the disclosed embodiments, as well as alternate embodiments, of the present invention may become apparent to one skilled in the art without departing from the spirit and scope of the invention as defined by the appended claims.

What is claimed is:

1. In a rotary type apparatus of the type including a stator housing defined by a peripheral wall and end walls defining a central chamber therein, a rotor eccentrically mounted to rotate within said central chamber, vanes adapted to reciprocate within diametrically opposed, longitudinally and radially extending slots within the wall of said rotor, and a support assembly for structurally supporting and mounting diametrically opposed vanes within said rotor, the improvement wherein said support assembly comprises:

a. support rod means operatively coupling said diametrically opposed vanes, said support rod means including a pair of support rods rigidly coupled at respective opposed ends thereof to said opposed vanes, said pair of support rods having respective free end portions translatably coupled at a situs between said opposed ends, the free end portion of one of said pair of support rods having a cross-section defining a channel, the free end portion of the other support rod having a generally T-shaped cross section mateably received within said channel, and b. roller bearing means disposed within said channel and coupling the free end portions of said pair of support rods at said situs.

2. The improvement as defined by claim 1 wherein a pair of springs are provided within respective sockets in said opposed vanes and yieldably engage said free end portions to urge said opposed vanes away from one another.

3. In rotary type positive displacement apparatus of the type including a stator housing formed by a substantially cylindrical peripheral wall and two end walls defining a central chamber therein, a rotor eccentrically mounted to rotate within said central chamber, vanes adapted to reciprocate within diametrically opposed, longitudinally and radially extending slots within the wall of said rotor, and a support assembly for structurally supporting and mounting diametrically opposed vanes with said rotor, the improvement wherein said support assembly comprises:

a. at least one support rod operatively coupling said diametrically opposed vanes, said at least one support rod having one end rigidly coupled to one of the vanes, the other end translatably coupled with the other diametrically opposed vane, and b. a bearing assembly provided at the situs of translatable coupling of said other rod end with, and located within a radially aligned socket of, said other diametrically opposed vane, c. said bearing assembly comprising first means slidably engaging said at least one support rod and second means pivotally coupled with opposed walls of said radially aligned socket.

4. In rotary type positive displacement apparatus of the type including a stator housing formed by a substantially cylindrical peripheral wall and two end walls defining a central chamber therein, a rotor eccentrically mounted to rotate within said central chamber, vanes adapted to reciprocate within diametrically opposed, longitudinally and radially extending slots within the wall of said rotor, and a support assembly for structurally supporting and mounting diametrically opposed vanes with said rotor, the improvement wherein said support assembly comprises:

a. at least one support rod operatively coupling said diametrically opposed vanes, said at least one support rod having one end rigidly coupled to one of the vanes, the other end translatably coupled with the other diametrically opposed vane, and b. a bearing assembly provided at the situs of translatable coupling of said other rod end with, and located within a radially aligned socket of, said other diametrically opposed vane, c. said bearing assembly having first means slidably engaging opposed walls of said radially aligned socket and second means pivotally coupled with said at least one support rod.

5. In rotary type positive displacement apparatus of the type including a stator housing formed by a substantially cylindrical peripheral wall and two end walls defining a central chamber therein, a rotor eccentrically mounted to rotate within said central chamber, vanes adapted to reciprocate within diametrically opposed, longitudinally and radially extending slots within the wall of said rotor, and a support assembly for structurally supporting and mounting diametrically opposed vanes with said rotor, the improvement wherein said support assembly comprises:

a. at least one support rod operatively coupling said diametrically opposed vanes, said at least one support rod having one end rigidly coupled to one of the vanes, the other end translatably coupled with the other diametrically opposed vane, and b. a bearing assembly provided at the situs of translatable coupling of said other rod end with, and located within a radially aligned socket of, said other diametrically opposed vane, c. said bearing assembly comprising at least one tilting pad assembly slidably engaging said at least one support rod and pivotally coupled with opposed walls of said radially aligned socket.

6. In rotary type positive displacement apparatus of the type including a stator housing formed by a substantially cylindrical peripheral wall and two end walls defining a central chamber therein, a rotor eccentrically mounted to rotate within said central chamber, vanes adapted to reciprocate within diametrically opposed, longitudinally and radially extending slots within the wall of said rotor, and a support assembly for structurally supporting and mounting diametrically opposed vanes with said rotor, the improvement wherein said support assembly comprises:

a. at least one support rod operatively coupling said diametrically opposed vanes, said at least one support rod having one end rigidly coupled to one of the vanes, the other end translatably coupled with the other diametrically opposed vane, and b. a bearing assembly provided at the situs of translatable coupling of said other rod end with, and located within a radially aligned socket of, said other diametrically opposed vane, c. said bearing assembly comprising at least one tilting pad assembly slidably engaging opposed walls of said radially aligned socket and pivotally coupled with said at least one support rod.

* * * * *